US006482514B1

(12) United States Patent
Matsumoto et al.

(10) Patent No.: US 6,482,514 B1
(45) Date of Patent: Nov. 19, 2002

(54) DEODORANT RAYON FIBERS AND METHOD FOR PRODUCING THE SAME

(75) Inventors: Mitsugu Matsumoto, Minabegawa-mura (JP); Akira Shimizu, Osaka (JP); Seiichi Nishijima, Wakayama (JP)

(73) Assignees: Minabegawa Village Co-op Forest, Wakayama (JP); Omikenshi Co. Ltd., Osaka (JP); Daito Knit Co. Ltd., Wakayama (JP)

( * ) Notice: Subject to any disclaimer, the term of this patent is extended or adjusted under 35 U.S.C. 154(b) by 0 days.

(21) Appl. No.: 09/827,340

(22) Filed: Apr. 6, 2001

(51) Int. Cl.[7] ..... D01F 56/02; D01D 5/06
(52) U.S. Cl. ..... 428/372; 428/393; 264/188
(58) Field of Search ..... 428/372, 393; 264/188

(56) References Cited

U.S. PATENT DOCUMENTS 5,443,886 A * 8/1995 Cohen ..... 428/131
5,514,308 A * 5/1996 Cohen et al. ..... 264/442
6,151,733 A1 * 11/2001 Takashima ..... 3/636
6,335,075 B1 * 1/2002 Seto et al. ..... 428/96

FOREIGN PATENT DOCUMENTS

JP 2001009812 A * 1/2001
JP 2001098412 A * 4/2001

* cited by examiner

*Primary Examiner*—N. Edwards
(74) *Attorney, Agent, or Firm*—Jones, Tullar & Cooper, P.C.

(57) ABSTRACT

The invention provides deodorant rayon fibers having a superior deodorization performance. The deodorant rayon fibers are produced by implanting a large quantity of fine grains produced by milling white charcoal in a matrix of the rayon fiber. After adding and mixing a water dispersion which disperses the large quantity of fine grains into viscose solutin, and then spinning, thereby the deodorant rayon fibers are produced. The fine grains obtained by milling the white charcoal do not form spheres with smooth surfaces, but their configurations are irregular with projections. As a result, even when they are implanted in the matrix of the rayon fiber, the projections tend to be exposed on the surfaces of the rayon fibers. The exposed fine grains adsorb odor gases into themselves, thereby their superior deodoization performance is performed.

4 Claims, 2 Drawing Sheets

DEODORANT RAYON FIBERS AND METHOD FOR PRODUCING THE SAME

TECHNICAL FIELD

The present invention relates to rayon fibers superior in deodorization performance and to a method for producing the rayon fibers.

BACKGROUND ART

Deodorization treatment has been conventionally applied to rayon fibers used as wadding and rayon fibers for clothing in order to prevent quilts or clothes from offensive smelling. The deodorization treatment has been also applied to rayon fibers used in carpet, wall cloth, or the like, in order to prevent a room from offensive smelling by adsorbing it into the carpet or the like.

As one of such deodorant rayon fibers, a deodorant rayon fibers containing fine grains of activated charcoal, into which metal complex of phthalocyanine is adsorbed, in a matrix of the rayon fiber are known (the Japanese Patent Publication (unexamined) No. 300769/1988). This deodorant rayon fibers transforms odor molecules into odorless molecules (odorless components) through a chemical reaction between the metal complex of phthalocyanine adsorbed by the fine grains of activated charcoal and the odor molecules. It is to be noted that, in this known art, the fine grains of activated charcoal are used just for carrying the metal complex of phthalocyanine, and not for adsorbing the odor molecules. This is because when the fine grains of activated charcoal are contained in the matrix of the rayon fiber, micropores of the fine grains of activated charcoal are coated or covered by cellulose and the power for adsorbing the odor molecules is almost lost. In other words, when such a type of deodorant as adsorbing the odor molecules into micropores (activated charcoal is typical) is implanted (contained) in the matrix of the rayon fiber, its deodorization performance is lost. As a result, it is impossible to give any deodorization performance to the rayon fibers. This has been a common technical sense in the field of art.

However, the inventors have found that a specific deodorant among the deodorants of the type adsorbing the odor molecules into the micropores does not substantially lose its deodorization performance even if the deodorant is implanted in the matrix of the rayon fiber. Moreover, the inventors have also unexpectedly found that deodorization performance is further improved for a certain kind of odor components as compared with the deodorization performance achieved by using the specific deodorant alone, and that the specific deodorant produces minus ions under specific conditions. (It is usually said that the more minus ions exist, the more favorable environment is provided for human body.)

SUMMARY OF THE INVENTION

The present invention was made on the basis of the foregoing discoveries.

The present invention relates to deodorant rayon fibers implanting fine grains, which are produced by milling white charcoal made by carbonizing an oak, in a matrix of the rayon fiber. Scratch hardness of the white charcoal is prefferably more than 15 degree. The degree of the scratch hardness is set on the basis of the scratch hardness of steel and lead. That is, the scratch hardness of steel is 20 degree, and the lead is 1 degree.

It is preferable in the present invention to use "Binchotan" charcoal which is a kind of white charcoal. "Binchotan" charcoal is a white charcoal made in Japan. "Binchotan" charcoal is produced by carbonizing "Ubamegashi" which is a kind of oak. Scratch hardness of "Binchotan" charcoal is simillar to that of steel or harder than steel.

In general, a viscose rayon fiber is used as the rayon fiber, and it is also preferred to use a cuprammonium rayon fiber or an acetate rayon fiber as the rayon fiber.

The most significant characteristic of the present invention is that fine grains produced by milling white charcoal, prefarably "Binchotan" charcoal, are used as a deodorant to be implanted in the matrix of the rayon fiber. It is considered that once using the fine grains of white charcoal, deodorization function is not easily deteriorated even if the fine grains are implanted in the matrix of the rayon fiber by the following reasons. The white charcoal has a property of being harder than activated charcoal and black charcoal. Espesially, the "Binchotan" charcoal is simillar to or harder than steel in hardness, therefore cannot be cut with a saw, and the teeth of the saw will be nicked instead of cutting the "Binchotan" charcoal. Accordingly, when such a hard white charcoal is mlled into fine grains by applying shock and friction using a hammer mill, a ball mill or the like, the fine grains do not form spheres with smooth surfaces, but their configurations become irregular with recessions and projections. When a large quantity of such fine grains of the white charcoal is implanted in the matrix of the rayon fiber, the projections on the surfaces of the fine grains are in contac with the surface of the rayon fiber at a large number of points "a" as shown in FIG. 1. (FIG. 1 is a schematic view showing a cross section of the deodorant rayon fiber). At these points "a", the projections of the fine grains are sometimes exposed. In other cases, the projections are not originally exposed, but when the surface of the rayon fiber is rubbed, the surface of the rayon fiber is gradually damaged, and consequently, the projections of the fine grains are finally exposed. It is therefore considered that odor components are taken or adsorbed into the fine grains through these exposed portions, whereby the deodorization function is performed.

It is considered that this is the very reason why the deodorization performance of the rayon fibers, in the matrix of which the large quantity of fine grains is implanted, is not easily deteriorated.

The deodorant rayon fibers according to the invention are generally produced as described below. First, the white charcoal is prepared and milled to obtain a large quantity of fine grains of the white charcoal. Any of publicly known methods can be used. It is, however, preferred to use a two-stage milling method in which rough milling is performed at first stage, and fine milling is performed at next stage. The most preferable process method is to use the two-stage milling method in which the rough milling is performed by dry milling, and wet milling performs the fine milling. Any of publicly known milling machines can be used. It is, however, preferred to use a hammer mill, a roll crusher, or the like in the rough milling, and use a ball mill, a tower mill, or the like in the fine milling.

Grain diameter of the fine grains of the white charcoal can be any value as far as the grain diameters are small enough to be implanted in the matrix of the rayon fiber. It is, however, preferred that at least 95% of the large quantity of the fine grains is less than 1.0 $\mu$m in grain diameter. If less than 95% of the fine grains are less than 1.0 $\mu$m in grain diameter, when adding and mixing the fine grains into viscose solution, there arises a possibility that the viscose solution increases its viscosity, eventually resulting in occurrence of gelation. In addition, distribution of the grain diameters of the fine grains can be measured using a coal counter or the like. The large quantity of fine grains obtained in this manner is then dispersed in water to produce water dispersion. In the dispersion of the fine grains in water, it is preferred to use a suitable dispersant such as surfactant, but it is not always necessary to use a dispersant Furthermore, in case that the fine grains are obtained through the wet milling using water (any dispersant such as a surface-active agent is contained therein in some cases), those fine grains are already dispersed in water. Therefore, it is also preferred to use them as they are. Rate of the fine grains in the water dispersion is preferably in the range of 5 to 80 weight percent. If the ratio is less than 5 weight percent, number of the fine grains implanted in the matrix of the rayon fiber tends to be insufficient. On the other hand, if the ratio is more than 80 weight percent, obtaining the water dispersion in which the fine grains are stably dispersed tends to be difficult, With respect to the viscose solution into which the water dispersion are added and mixed, any publicly known viscose solution can be used for producing viscose rayon fibers. More specifically, it is preferred to use the viscose solution in which the ratio of contained cellulose is approximately in the range of 7 to 10 weight percent, and the ratio of alkali such as caustic soda to the cellulose is approximately in the range of 50 to 80 weight percent. It is preferred that the viscose solution optionally contains any additional agent such as various kinds of metallic salts and antistatic agents. The water dispersion produced by dispersing the large quantity of fine grains of the white charcoal can be added and mixed into the viscose solution at any time before spinning. It is, however, most preferable to add and mix the water dispersion just before spinning. With the passage of a long time after adding and mixing the water dispersion, the fine grains tend to cohere or sediment, whereby maintaining the state of being uniformly mixed becomes difficult. With respect to the adding method, any publicly known method can be adopted. It is, however, preferred to quantitatively and continuously add the water dispersion into the viscose solution usin an injection pump.

It is possible to add any quantity of fine grains of the white charcoal into the viscose solution. In general, it is preferred to add the fine grains to the weight of the cellulose in the viscose solution in the range of 1 to 40 weight percent, more preferably, 5 to 20 weight percent. If the adding quantity of the fine grains is less than 1 weight percent, the quantity of the fine grains implanted in the matrix of the rayon fiber is insufficient, and there is a possibility that the deodorization function is not sufficiently performed. On the other hand, if the adding quantity of the fine grains is more than 40 weight percent, there arises a tendency of lowering in spinning characteristic, and easily dropping out of the fine grains from the obtained deodorant rayon fibers. There may further arise a tendency of deteriorating the physical properties such as strength and elongation of the deodorant rayon fiber.

After obtaining a mixture by adding and mixing the water dispersion to the viscose solution, spinning is performed in the same manner as that in producing the rayon fibers. More specifically, the mixture is extruded from a spinning nozzle into coagulating solution (temperature of the solution is approximately in the range of 40 to 50° C.). The coagulating solution contains 80 to 120 g/l of sulfuric acid and 50 to 360 g/l of sulfate of soda as main components. The mixture extruded into the coagulating solution is transformed into regenerated cellulose and coagulates, and then is optionally subject to drawing, thus rayon fibers being obtained. In this invention, since the fine grains exist into the mixture, the deodorant rayon fibers, in which the large quantity of fine grains is implanted in the matrix of the rayon fiber, are obtained by the method described above.

The deodorant rayon fibers obtained in this manner are used in the form of long fibers or short fibers of any desired fiber length. A deodorant yarn is obtained by spinning those deodorant rayon fibers. Instead of obtaining such yarn, it is possible to integrate the deodorant rayon fibers to form them into deodorant wadding, or to obtain a deodorant non-woven fabric by conbining the deodorant rayon fibers each other by any suitable means. Furthermore, by knitting or weaving the deodorant yarns obtains deodorant fabric. The deodorant non-woven fabric etc. are suitably applied to publicly known uses as a material for, for example, a clothing, a bed sheet, a pillowcase, a blanket, a carpet, a wall cloth, a cloth for stuffed toys, a curtain, a covering cloth, a cushion cover, and a lining cloth for vehicles.

Other objects, features and advantages of the invention will become apparent in the course of the following description with reference to the accompanying drawings.

Figure 1:
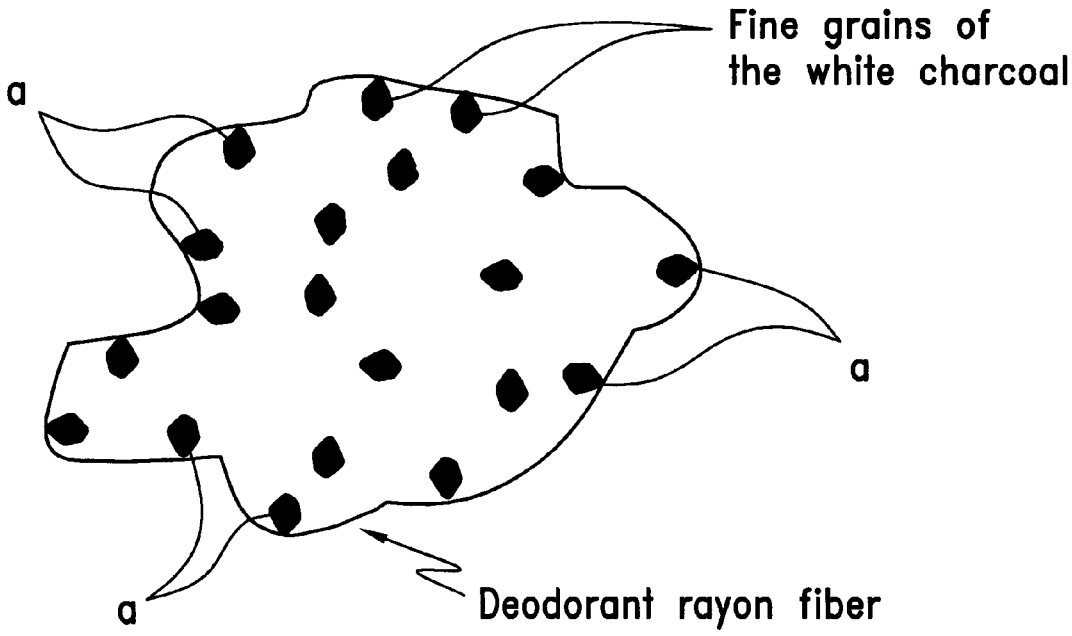
FIG. 1 is a schematic view showing a cross section of the deodorant rayon fiber according to an example of the present invention.

An example of the present invention is hereinafter described. The invention is not limited to this example. It is to be understood that the invention is based on the discovery that fine grains of the white charcoal does not lose their deodorization function even if they are implanted in the matrix of the rayon fiber.

EXAMPLE

"Binchotan" charcoal of 94.5% in fixed carbon and 1.92 g/cm$^2$ in specific gravity was milled in dry milling, and then a wet milling process was performed to obtain a water dispersion of fine grains of "Binchotan" charcoal (weight rate of the fine grains was 20 weight percent). In the obtained water dispersion, hot less than 95% of the fine grains were less than 1.0 $\mu$m in grain diameter, and the average grain diameter was approximately 0.7 $\mu$m and the maximum grain diameter was 2.5 $\mu$m.

Pulp as a raw material was dipped in about 18% caustic soda aqueous solution, then compressed and milled, thereby alkali cellulose was obtained. After ageing the alkali cellulose, carbon disulfide was acted to obtain cellulose xanthate, which was then dissolved in a diluted caustic soda aqueous solution, thereby viscose solution was prepared. This viscose solution was 8.8% in content of cellulose, 5.9% in content of alkali and 50 seconds in viscosity (measured by falling-ball test).

The foregoing water dispersion was quantitatively and continuously added by using an injection pump to the foregoing viscose solution just before spinning, and the mixture was obtained by mixing uniformly. The quantity of the added fine grains was adjusted to be 10 weight percent with respect to the weight of the cellulose in the mixture. After that, the mixture containing the fine grains was spun from a spinneret having 10,000 holes nozzle holes each of which is 0.06 mm in diameter at a spinning speed of 68 m/min. in coagulation/regene ration bathing. The coagulation/regeneration bathing solution contains 110 g/l of sulfuric acid, 350 g/l of salt cake, and 15 g/l of zinc sulfate, and the solution temperature was 45° C. After the spinning, drawing by normal two-bath stretch spinning method, and cutting, thereby the deodorant rayon short fibers of 1.5 deniers in fineness and 51 mm in fiber length were obtained.

The deodorant rayon short fibers were 10.2 weight percent in content of fine grains of "Binchotan" charcoal, 1.98 g/d in dry strength, and 19.8% in dry elongation. That is, their strength and elongation were substantially the same as compared with normal viscose rayon short fibers, and sufficient in practical use.

(Deodorization Test 1)

30 gs of the deodorant rayon short fibers obtained in the example were put in a tetra bag of 5 liters volume. A test gas (ammonia, trimethylamine, and hydrogen sulfide) was poured to be 30 ppm in initial concentration, and then the residual gas concentration was measured with the passage of time by using Kitagawa-type detection tube. The results are as shown in Table 1.

(Deodorization Test 2)

The deodorant rayon short fibers obtained in the example were washed ten times using the JIS L-0844-A2 method, and then the residual gas concentration was measured in the same method as used in the Deodorization Test 1. The results are as shown in Table 1.

(Comparative Deodorization Test)

Other than substituting 50 gs of "Binchotan" charcoal which is not milled yet for 50 gs of the deodorant rayon short fibers, the residual gas concentration was measured in the same method as used in the Deodorization Test 1. The results are as shown in Table 1.

(Deodorization Blank Test)

Other than not putting the deodorant rayon short fibers in the bag, the residual gas concentration was measured in the same method as used in the Deodorization Test 1. The results are as shown in Table 1.

TABLE 1

| | | | Residual Gas Concentration (ppm) | | | | | |
|---|---|---|---|---|---|---|---|---|
| | | | Start | After 10 min. | After 30 min. | After 1 h. | After 2 h. | After 5 h |
| Type of Test Gas | Ammonia | Deodorization Test 1 | 30.0 | 0.4 | 0.1> | — | — | — |
| | | Deodorization Test 2 | 30.0 | 0.5 | 0.1> | — | — | — |
| | | Deodorization Comparative Test | 30.0 | 13.1 | 6.8 | 3.7 | 2.5 | 1.5 |
| | | Deodorization Blank Test | 30.0 | 30.0 | 30.0 | 30.0 | 30.0 | 30.0 |
| | Trimethylarmine | Deodorization Test 1 | 30.0 | 9.2 | 5.7 | 2.5 | 2.5 | 1.8 |
| | | Deodorization Test 2 | 30.0 | 9.7 | 5.8 | 2.5 | 2.5 | 1.8 |
| | | Deodorization Comparative Test | 30.0 | 20.8 | 17.9 | 17.9 | 15.4 | 11.9 |
| | | Deodorization Blank Test | 30.0 | 30.0 | 30.0 | 30.0 | 30.0 | 30.0 |
| | Sulfureted | Deodorization Test 1 | 30.0 | 12.0 | 3.3 | 1.0 | 0.2 | 0.1> |
| | Hydrogen | Deodorization Test 2 | 30.0 | 12.3 | 3.4 | 1.0 | 0.2 | 0.1> |
| | | Deodorization Comparative Test | 30.0 | 0.5> | — | — | — | — |
| | | Deodorization Blank Test | 30.0 | 30.0 | 30.0 | 30.0 | 30.0 | 30.0 |

In Table 1, the portions indicated by '--' mean that residual concentration gas was not detected.

It is clearly understood from Table 1 that the deodorant rayon short fibers according to the example are capable of effectively adsorbing any of ammonia, trimethylamine and sulfureted hydrogen, which are typical offensive odor gases, and removing the offensive odor therefrom. In particular, with respect to ammonia and trimethylamine, the deodorant rayon short fibers according to the example absorb them swifter than "Binchotan" charcoal alone. Therefore, it may be said that using the deodorant rayon short fibers according to the example performs an unexpected advantage of superior deodorization performance as compared with using "Binchotan" charcoal alone.

(Minus Ion Measuring Test)

Figure 2:
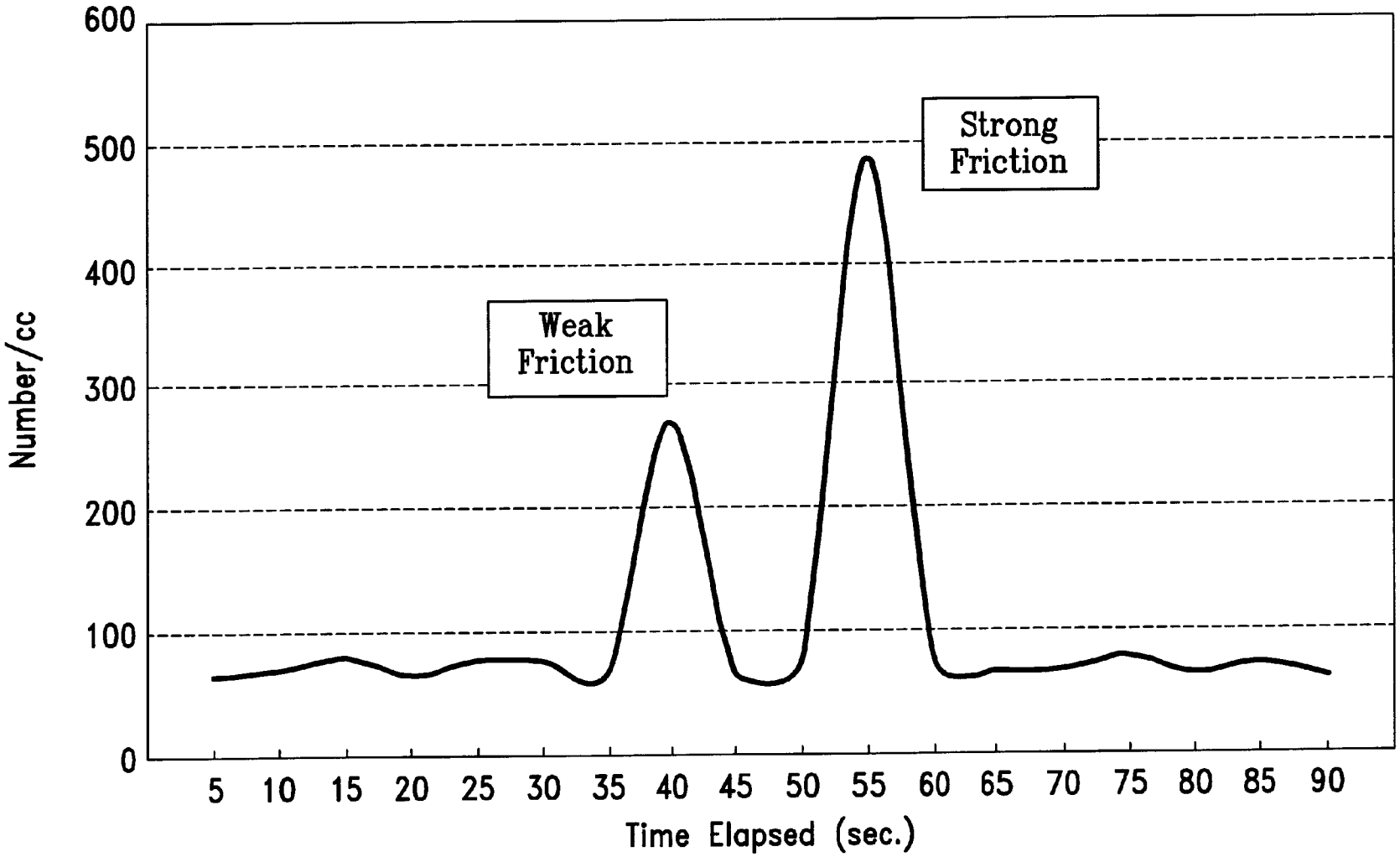
FIG. 2 is a graph showing the change in number of minus ions generated when the deodorant rayon short fibers of the example are subject to a minus ion-measuring test.

A measuring instrument manufactured by Kobe Electric Wave Inc. (ION TESTER KST-900 type) was used to measure number of minus ions generated by the deodorant rayon short fibers obtained in the example. The measurement was performed by putting the deodorant rayon short fibers on the measuring instrument, applying a weak friction to the rayon short fibers after 35 seconds, stopping the weak friction and applying a strong friction after 10 seconds, and then stopping the strong friction. The results are as shown in FIG. 2. The number of generated minus ions was so small as less than 100/cc before applying the friction. However, once applying the weak friction, the number of generated minus ions mounted to approximately 270/cc, and to approximately 500/cc when applying the strong friction. It is generally said that minus ions rarely exist in crowded downtown, and that the number of minus ions is approximately 350/cc at an airy place, while more than 700/cc in mountainous area. It is said that the more minus ions exist, the more favorable environment is provided for human body. Therefore when applying the deodorant rayon short fibers according to the example to any use in which friction is applied (for example, to a material for clothing, wadding, a bed sheet, and a pillowcase), a large quantity of minus ions is generated, and it is possible to provide suitable environment for human body.

As demonstrated in the foregoing example, the deodorant rayon fibers produced by implanting fine grains of the white charcoal in the matrix of the rayon fiber exhibit a superior deodorization performance. Their deodorization performance is superior to that of the white charcoal alone. The reason why such a function is performed is not always clear. It is, however, presumed that their deodorization performance is remarkable because the projections of the fine grains implanted in the matrix of the rayon fiber easily expose from surfaces of the rayon fibers, and because the white charcoal is milled into fine grains and the fine grains have extremely large specific surfaces. It is therefore possible to effectively remove an offensive odor and obtain a comfortable living environment by using the deodorant rayon fibers according to the invention as wadding, bed sheet, pillowcase, material for clothing, and so on. Both rayon fibers and fine grains of the white charcoal give negative influence little upon the human body, which makes it possible to promote the foregoing advantages.

In addition, since the deodorant rayon fibers according to the invention contain the fine grains of the white charcoal, depending upon the manner they are used, it is possible to obtain advantages peculiar to the white charcoal such as minus ion effect, adsorption of chemicals which cause sick house syndrome, electromagnetic wave screening effect, thermal effect by far-infrared rays, or conditioning effect.

What is claimed is:

1. Deodorant rayon fibers implanting fine grains, which are produced by milling white charcoal made by carbonizing an oak, in a matrix of the rayon fiber.

2. A method for producing deodorant rayon fibers comprising of preparing fine grains produced by milling white charcoal which is made by carbonizing an oak, and preparing water dispersion which disperses the fine grains into water, and preparing a mixture of the water dispersion and viscose solution, and spinning the mixture.

3. The method for producing deodorant rayon fibers according to claim 2, wherein not less than 95% of the fine grains is less than 1.0 $\mu$m in grain diameter.

4. The method for producing deodorant rayon fibers according to claim 2, wherein the quantity of the fine grains in the mixture is in the rage of 1 to 40 weight percent with respect to the weight of cellulose in the mixture.

* * * * *